United States Patent [19]

Hasbrouck

[11] Patent Number: 4,477,128

[45] Date of Patent: Oct. 16, 1984

[54] PARTITION SYSTEM STORAGE UNIT SUPPORTS

[75] Inventor: Gene B. Hasbrouck, Corry, Pa.

[73] Assignee: Hon Industries Inc., Muscatine, Iowa

[21] Appl. No.: 329,806

[22] Filed: Dec. 11, 1981

[51] Int. Cl.[3] ..... A47B 87/00; F16B 12/00

[52] U.S. Cl. ..... 312/111; 312/107; 312/108; 312/263

[58] Field of Search ..... 312/111, 263, 108, 264, 312/140, 199, 200

[56] References Cited

U.S. PATENT DOCUMENTS

| | | | |
|---|---|---|---|
| 692,052 | 1/1902 | Forster | 312/111 |
| 1,340,562 | 5/1920 | Sandmann | 312/111 |
| 2,311,723 | 2/1943 | Anderson | 312/111 |
| 2,576,409 | 11/1951 | Michaelis et al. | 312/107 |
| 2,790,691 | 4/1957 | Goebel | 312/111 |
| 3,159,438 | 12/1964 | Carlson et al. | 312/111 |
| 3,784,273 | 1/1974 | Nikolai | 312/263 |
| 3,807,572 | 4/1974 | Luvara et al. | 312/108 |
| 4,223,613 | 9/1980 | Yoshizawa | 312/108 |
| 4,227,758 | 10/1980 | Clare | 312/111 |
| 4,232,916 | 11/1980 | Correia | 312/108 |

FOREIGN PATENT DOCUMENTS

| | | | |
|---|---|---|---|
| 1574003 | 7/1969 | France | 312/111 |

*Primary Examiner*—Victor N. Sakran

*Attorney, Agent, or Firm*—Neuman, Williams, Anderson & Olson

[57] ABSTRACT

There is disclosed an intermediate support member for use with multiple suspended storage units in a portable panel partition system. The support member has a hanger for straddling and bearing on the adjacent end posts of two portable partition panels and hanging support on those two panels, with bolts for snug tension joining of the adjacent ends of two hanging storage units through the support member to form a rigid truss-like unit of the storage and support components to avoid sagging of those units. The support member is of an appropriate thickness to insure a snug fit of the rigid unit between the end panels. Interlocking tabs and shoulders prevent unhooking of the storage units and support member from the panels.

17 Claims, 5 Drawing Figures

FIG. 1
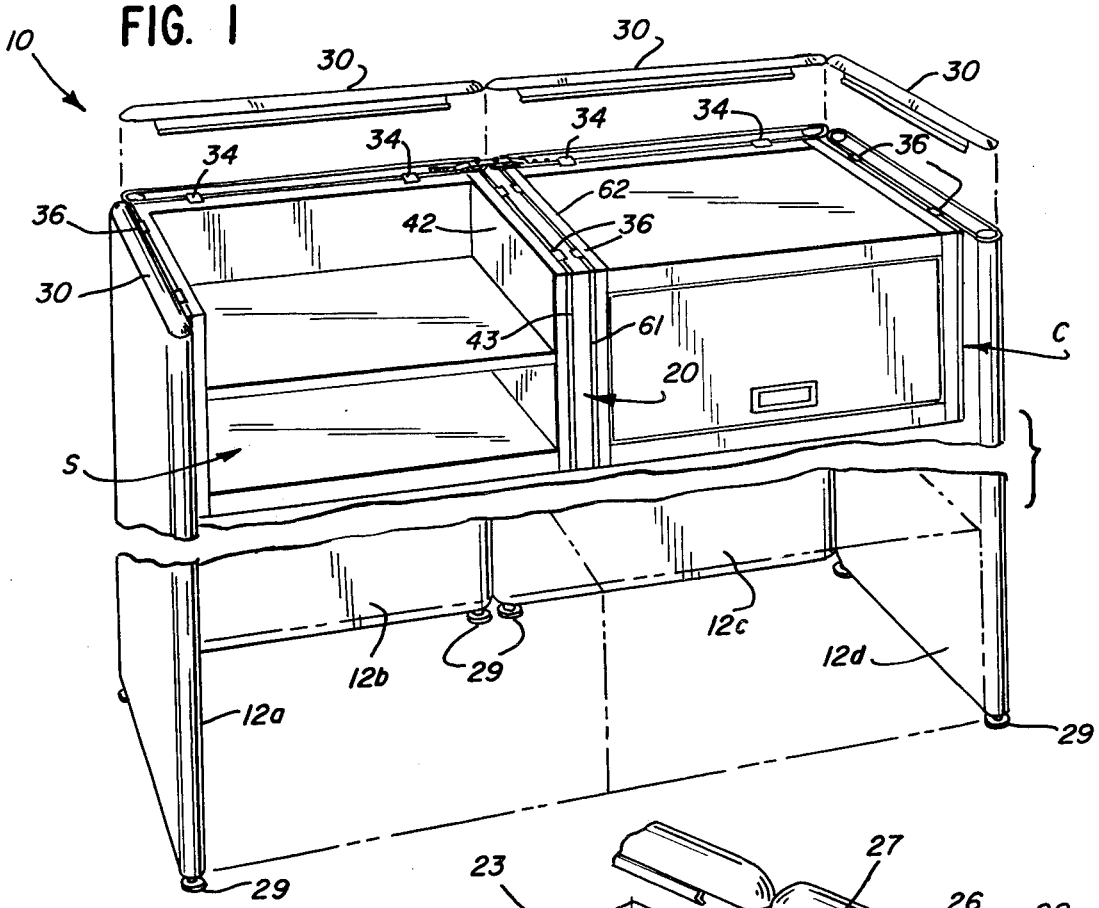
FIG. 3
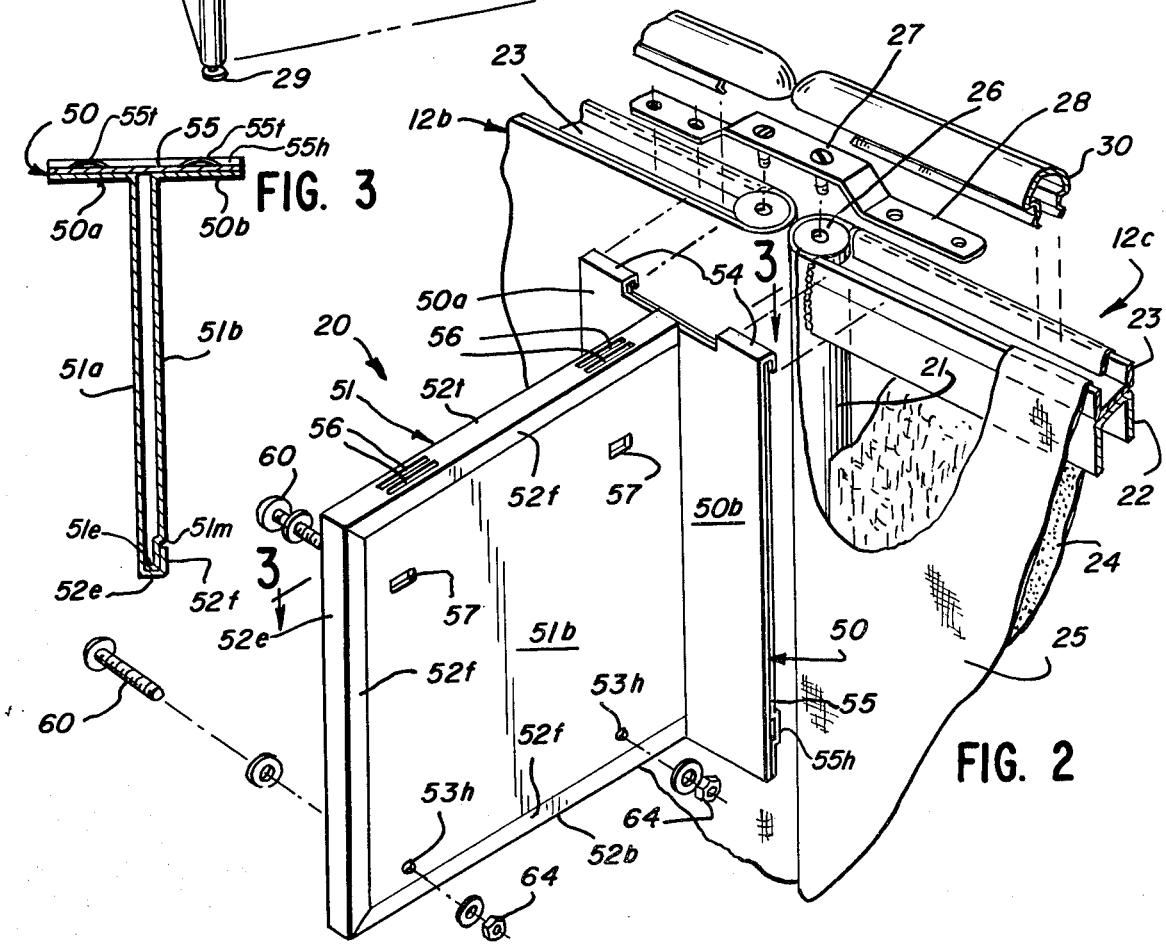
FIG. 2

PARTITION SYSTEM STORAGE UNIT SUPPORTS

BACKGROUND OF THE INVENTION

This invention relates to movable partition systems and particularly to the manner of support of storage units such as shelves, cabinets and other storage units in such systems.

A wide variety of partition systems have been proposed in which multiple prefabricated panels are assembled in various configurations to define work stations, corridors, etc. within large otherwise open office spaces. These are sometimes referred to as office landscape systems. The panels normally are joined to one another side-by-side in various layout configurations or patterns to define the work stations or bays, with some of the panels at angles to others both to define the side limits of individual bays or stations and to provide stability for the entire system. For example, a single modular panel may form the back wall of a work bay or station. Similarly, two or more panels in aligned coplanar array may form the rear wall of a larger bay or station. In either event, lateral panels at each end will delimit the space and provide lateral stability to the system.

Partition systems as alluded to above also often include arrangements for attaching a variety of functional service units such as shelving, counters, cabinets and the like. Elevated components typically are suspended from the panels or from posts interposed between adjacent panels. Such suspended components, which are referred to herein collectively as storage units, may be required to carry heavy loads, e.g., a functional load of 181 ½ pounds and a proof load of 302 ½ pounds for a unit 63 ⅛ inches long (3 lb. and 5 lb., respectively per lineal inch of filing space).

The storage units often are of modular length corresponding to the effective installed width of a standard panel. When a work bay is formed which is two or more panels wide, often it is necessary to hang two or more such storage units in end-to-end arrangement without an intervening lateral panel. This, of course, means that there is no contiguous lateral panel available to support the adjacent inner ends of those units. Such units functionally can be supported by attachment to the back panels and to the lateral panels along the outer ends of the units, and even to a bracket or brackets at the inner ends of the units, which brackets are supported on the back panels or posts. However, experience has shown that those units will tend to sag at their adjacent inner ends when loaded and thereby present an unpleasing appearance, particularly when the units are formed of sheet metal or are of any nonrigid construction.

OBJECTS OF THE INVENTION

It is an object of this invention to provide an improved support arrangement in partition systems which will overcome the aforenoted problems.

It is another object of this invention to provide an improved support for the inner ends of multiple aligned adjacent storage units, particularly in multi-panel bays.

It is another object of this invention to provide improved panel partition systems in which multiple storage units arranged end to end will be supported level and in alignment with one another.

It is a further object of this invention to provide a support system for storage units which affords convenient compensation for variations from modular spacing in multi-panel bays.

It is a further object of this invention to provide an improved arrangement for preventing inadvertent unhooking of suspended units from the support system.

SUMMARY OF THE INVENTION

An intermediate support member is provided for disposition between two storage units which are designed to be suspended on panels of a partition assembly in end to end alignment with one another. The support member includes means for suspending that member on the same partition, usually in spanning relation to the joint between two partition panels. Means such as bolts are provided for drawing the adjacent ends of the storage units into rigid tensile attachment with one another through the intermediate support member, particularly at the lower edges of the storage units and support member, to effectively form those components into a rigid beam or truss structure. In the preferred arrangement, the intermediate support member is of an appropriate thickness to adjust the overall length of the assembly of storage units and support member to the span between lateral panels of a partition having a back wall of multiple partition panels.

Also, end and back hanger plates for the storage units and support member have protuberances which engage beneath shoulders on the engaged panels and intermediate support member. The storage units maintain the engagement of these protuberances beneath the shoulders, to preclude the suspended units from inadvertently being detached from the panels and intermediate support.

BRIEF DESCRIPTION OF THE DRAWINGS

For a more complete understanding of this invention, reference should now be made to the embodiment illustrated in greater detail in the accompanying drawings and described below by way of an example of the invention. In the drawings:

FIG. 1 is a perspective view of a partition panel assembly defining a bay or work station and including a support arrangement for the storage units embodying teachings of this invention, with desk or counter units shown in phantom lines;

FIG. 2 is an enlarged, partial, exploded view of the intermediate support member and adjacent portions of the panels of the assembly of FIG. 1;

FIG. 3 is a sectional view of the intermediate support member taken generally along line 3—3 of FIG. 2;

Figure 4:
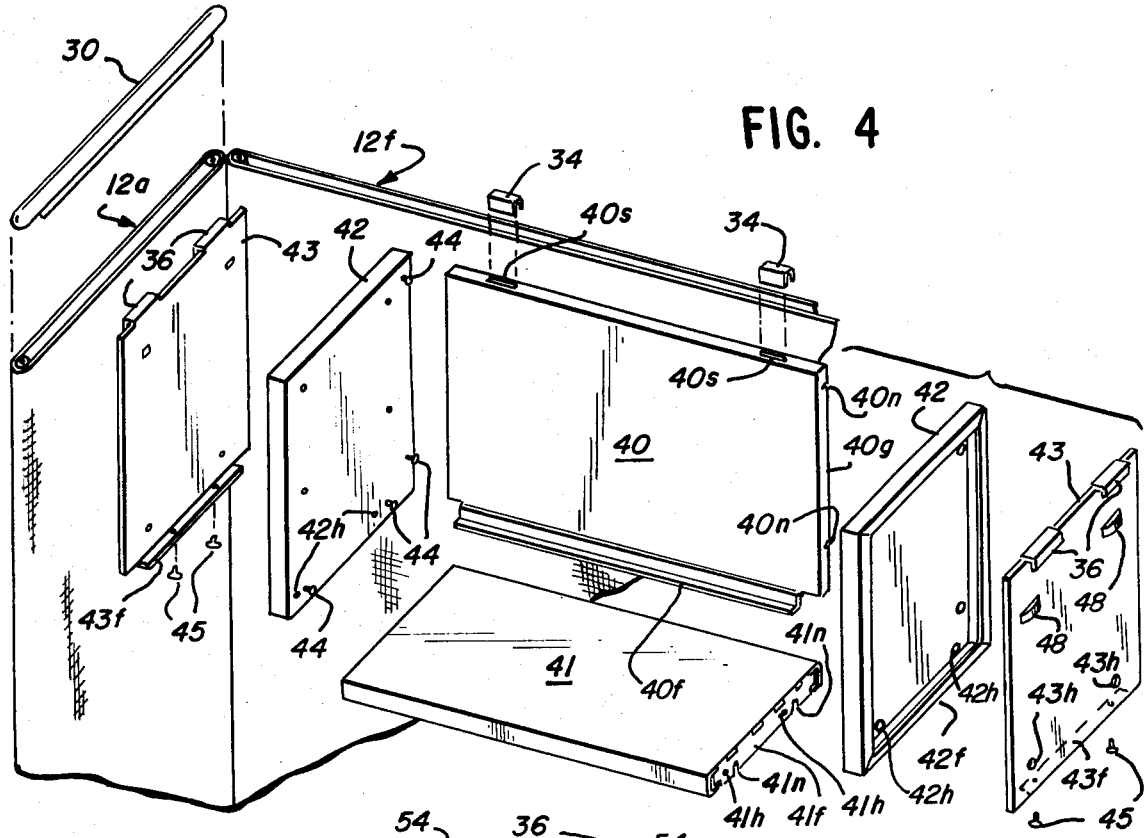
FIG. 4 is a partial exploded view of the shelf unit and adjacent panels of the assembly in FIG. 1.

It should be understood that the drawings are not necessarily to scale and that the embodiment is sometimes illustrated in part by phantom lines and fragmentary views. In certain instances, details of the actual structure which are not necessary for the understanding of the present invention may have been omitted. It should be understood, of course, that the invention is not necessarily limited to the particular embodiment illustrated herein.

Turning first to FIG. 1, there is illustrated an assembly 10 of portable partition panels 12*a*, 12*b*, 12*c* and 12*d* defining a work bay or station of a width corresponding generally to the width of the two modular back panels 12*b* and 12*c*. A pair of storage units comprising a shelf assembly S and a cabinet unit C are illustrated as being suspended on the upper portions of the panels, with a pair of desk or counter units being illustrated in phantom lines in the lower portion of that station. The illustrated panel system, storage units and support arrangements are as in the "2000" panel system presently being marketed commercially by Corry Jamestown Corporation of Corry, Pa., which is a division of HON INDUSTRIES, Inc., of Muscatine, Iowa. The specific panels and their manner of assembly to one another in a work station layout, and the details of the storage units, are presented to illustrate a preferred embodiment of the invention and its manner of practice. They do not themselves constitute a part of this invention.

It will be appreciated that partition panels such as panels 12 may be assembled in a wide variety of floor plan layout configurations, and may define work stations of various configurations and widths, e.g., a width equal to the effective assembled width of a single modular panel 12*b* or 12*c* between laterally-extending end panels 12*a* and 12*b* or a width equivalent to two or more of the modular panels 12*b* and 12*c*. The present invention is particularly applicable for suspending shelving, cabinets or other components in a bay or station which is of a width equivalent to two or more of the assembled panels, such as the two panel unit of FIG. 1. As noted above, such suspended units are referred to generically herein as "storage units".

With continued reference to FIG. 1, the system 10 is designed such that the storage units are suspended on the assembled panels by end hangers, in a manner which is described in greater detail below. An intermediate support member 20 is supported on the back panels 12*b* and 12*c*, spanning the abutment joint therebetween. The storage units S and C are suspended at their inner ends on the upper edge of this support member, and are rigidly joined to this support and to one another by tension members at the lower edges of these components, all in the manner described in greater detail below.

Referring also to FIG. 2, each of the panels 12 includes a frame comprising a vertical hollow round tubular post 21 at each side edge, and transverse channel members 22 and 23 joined to these posts as by welding. Appropriate core materials 24, such as of glass fiber, are included for sound attenuation purposes. A sleeve of fabric 25 covers each complete panel for appearance purposes. As best seen in FIG. 2, the channels 22 and 23 are disposed back-to-back to form a composite H section. The top channel 23 is open upwardly. The side flanges 22 of the lower channel extend downwardly. The end edges of the fabric 25 are turned downward into the top channel 23 and into the upper end of the respective tube 21 and are suitably attached thereto, such as by adhesion.

An element 26 is inserted in the upper end of each tube and receives a fastener 27 for attaching a bracket 28 to join the adjacent panels in abutting coplanar alignment with one another as in the instance of the panels 12*b* and 12*c*. It will be appreciated that various other brackets of appropriate designs also are utilized for joining the panels 12 in other configurations, such as for the angular connections between the lateral panels 12*a*, 12*d* and the back panels 12*b*, 12*c*, or for T connections between two aligned panels and a lateral panel. A similar structure and joining brackets, clips or other devices are provided at the lower end of each panel and joint, together with adjustable glide supports 29 or other bases. In addition, top trim elements 30 of appropriate decorative configuration are attached to the tops of the panels, as by friction clip engagement, after the assembly is completed, for appearance purposes.

In the partition assembly 10, each of the storage units is provided with two top support clips 34, each of which is of C-shape in cross section and adapted to be hooked over the adjacent flanges of the top channels 23 of the back panels for restraining that storage unit from sliding forward on the panel assembly. Each storage unit is of a modular length corresponding to the width of a work station provided between the lateral end panels when a standard back panel 12*b* or 12*c* has a lateral end panel, such as panels 12*a* and 12*d*, joined thereto at each end of the back panel. In such a single panel station, the modular storage unit is suspended directly on both of the lateral end panels by hangers 36 and held rearwardly against the back panels by the clips 34.

By way of further illustration of a typical storage unit, FIG. 4 illustrates a shelf unit S in an exploded view, with a single shelf. That unit includes a back panel 40, bottom shelf panel 41, opposite end panels 42 and hanger panels 43. Each back panel 40 has a bottom flange 40*f* and opposite end flanges 40*g*, each of the latter having a pair of notches 40*n* therein. The bottom shelf panel includes end flanges 41*f*, each having a pair of notches 41*n* and a pair of holes 41*h* therethrough. In assembly, the notches 40*n* and 41*n* engage over screws 44 in the end panels 42, which screws are thereupon tightened to assemble these components. The C-shaped hanger clips 34 are attached through appropriate slots 40*s* in the back panels and extend rearwardly therefrom for engagement over a side flange of a top channel 23 of a panel 12.

The C-shaped hangers 36 are integral extensions of the upper edges of the hanger panels 43 and extend outwardly therefrom for suspension support of an assembled shelf unit, such as by being engaged over the adjacent flange lip of a channel 23 of a lateral end panel 12 or by being engaged with an intermediate support 20 as described further below. In outline, the hanger panels are hung on the end panels and/or intermediate support 20. A pair of locking tabs 48, which are struck and bent outwardly from each panel 43, engage beneath the lower edge or shoulder of the adjacent flange of a channel 22 or a corresponding shoulder provided on an intermediate support 20 and thereby prevent inadvertent unhooking of the hangers 36 from their support engagement. An assembled storage unit, such as the shelf unit S, then is positioned on the hanging panels 43, over the bottom flanges 43*f* thereof, and is attached thereto by appropriate screws 45 which extend through the respective bottom flanges 43*f* and into the contiguous overlying bottom flanges 42*f* of the respective contiguous end panel 42. The storage units fit snugly between a pair of end hangers 43 and thereby insure maintenance of the engagement of the tabs 48 with the respective shoulders for hold-down purposes.

Figure 5:
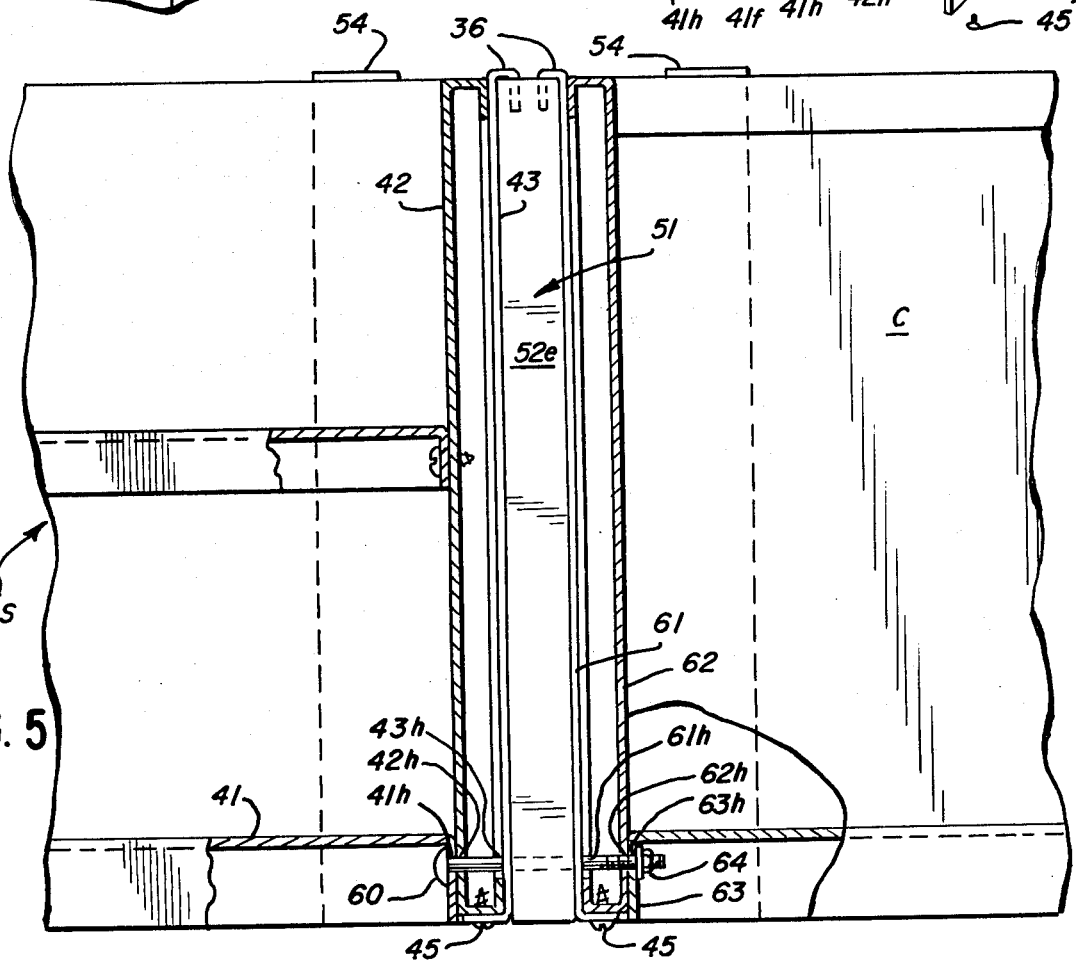
FIG. 5 is an enlarged front elevation view, partially in section, of the intermediate support member and the adjacent attached ends of the storage units of the assembly of FIG. 1.

Referring now to FIGS. 2, 3 and 5, the intermediate support 20 comprises a back hanger section 50 and a rectangular support body 51 extending forward from the back 50. The body 51 and portions of the back 50 are formed of two formed integral pieces, e.g., of bent sheet metal. One piece comprises a panel 51*a* forming one side of body 51, and top, end and bottom edge flanges 52*t*, 52*e* and 52*b* respectively extending normal to the panel 51*a*, with return flanges 52*f* at the distal edges thereof. The flanges 52*f* are parallel to panel 51*a*. One portion 50*a* of the back section also is integral with panel 51*a* and has a C-shape hanger tab 54 integral with its top edge. The other piece comprises panel 51*b* and integral back portion 50*b* which has another C-shape hanger tab 54 integral with its top edge. The panel 51*b* has peripheral flanges which correspond to flanges 52*t*, 52*e* and 52*b* but which are of reduced width to fit within the channels defined by the latter flanges, as illustrated by flange 51*e* in FIG. 3. These flanges on panel 51*b* are offset inwardly, as at 51*m*, so that the outer surfaces of panel 51*b* and flanges 52*f* are coplanar. The panel 51*b* is inserted from the rear into the channels defined by panel 51*a* and flanges 52, and is positioned against the inner surfaces of the flanges 52*f* and welded to those flanges. A pair of aligned holes 53*h* is provided through each of the panels 51*a* and 51*b* to receive bolts 60, as noted below.

The back hanger section 50 includes a reinforcing plate 55 which spans the inner faces of the back portions 50*a* and 50*b* and is spot welded thereto. A pair of locking tabs 52*t*, similar to tabs 48, are struck and bent outwardly of the plate 55 to engage the underside of the adjacent flange of channel 22 and thereby prevent inadvertent unhooking of the hangers 54 from channel 23 when the member 20 is in its support position. A rearwardly protruding hat-shape bearing rib 55*h* extends across the lower portion of plate 55 to bear against the posts 21 and assist in proper positioning of the member 20.

The top flange 52*t* and the underlying flange on panel 51*b* are formed with four slots 56 to receive the hanger tabs 36 of the hanger plates 43. A pair of openings 57 are provided in each of the panels 51*a* and 51*b* to receive the protruding locking dimples or tabs 48 of the hanger plates 43. The interengagement between the shoulders at the upper edges of these openings and the tabs 48 prevents the suspended units from upward sliding disengagement from the support 20. As noted above, the storage units insure maintenance of the engagement of tabs 48 beneath the upper shoulders of openings 57.

The width of the back section 50 and the spacing between the hanger tabs 54 is such that the back plate will span the joint between a pair of abutting panels 12 and the respective adjacent post tubes 21 of those two panels, and the tabs 54 will straddle the posts, whereby the support 20 hangs from the tops of both panels and the lower portion of the back plate section 50 rests against the two straddled posts.

A pair of bolts 60 extend through holes 41*h* of flange 41*f*, holes 42*h* in the end panel 42, holes 43*h* in the respective hanger panel, holes 53*h* through the intermediate support 20 and thence through corresponding aligned holes 61*h*, 62*h* and 63*h* in a hanger panel 61, end panel 62 and flange 63 of the cabinet unit C. By the application of a nut 64, or other suitable fastening arrangement, the lower portions of these components are drawn tightly together and held in position for transfer of tensile forces therebetween by the bolts 60, thereby effectively forming a truss or integral beam of the abutting componets C, S and 20 to support these componets and the loads which will be applied thereto in use. The adjustable take-up of the bolts insure that these components may be drawn tightly together and rigidly held. As a result, the components C, S and 20 will be supported in uniform, nonsagging alignment with one another across the span of two or more back panels, e.g., 12*b* and 12*c*, even where those components are formed of sheet metal or other slightly yielding or resilient materials.

The intermediate support 20 also serves a filler function to insure that the assembly of storage units and intermediate support will span the entire distance between the lateral panels 12*a* and 12*d* for proper engagement of the outer hanger panels with these panels and for appearance purposes. As noted above, each support unit, such as unit C and unit S, typically is of a predetermined length to fit snugly within a work station or bay as defined by a single back panel 12 having a lateral panel at either end. Having reference to FIGS. 1 and 4, it will be appreciated that the lateral panels overlap the respective ends of the back panels slightly (as viewed in front elevation), whereby the clearance between two such lateral panels is slightly less than the overall length of the back panel. On the other hand, with a multiple panel bay, such as the double panel bay of FIG. 1, there is no lateral panel at the center, and hence the span from panel 12*a* to 12*d* exceeds a distance equal to two times the effective modular space available within a single panel bay. The intermediate support 20 is of a width to compensate for this increase in spacing over a multiple of the storage unit module. Thereby the structure assures that the remote ends of the assembly C-20-S fit closely adjacent the respective end panels 12*d* and 12*a* for proper engagement of the hangers 36 and locking tabs 48 with the respective end panels and also to insure proper appearance. By way of example, with a "2000" panel system bay as in FIG. 1 having two abutting back panels, a support 20 has been used with a body 51 which is 15/16" thick.

By way of a further example, when a T-connection is made between three panels in a "2000" panel system, the edges of the two coplanar panels are spaced slightly from one another to accommodate the mutual lateral panel. Assuming for instance that a lateral panel is to be extended from the back of assembly 10 at the joint between panels 12*b* and 12*c*, the latter panels would be spaced apart 9/16". An intermediate support 20, 1 ½" thick then is used so that the assembly of two storage units and the intervening support member span the distance between the lateral end panels 12*a* and 12*d*.

Thus, a support system has been provided which meets the aforestated objects of this invention.

While a particular embodiment of the invention has been shown, it will be understood, of course, that the invention is not limited thereto since modifications may be made and other embodiments of the principles of this invention will occur to those skilled in the art to which this invention pertains, particularly upon considering the foregoing teachings. It is therefore, contemplated by the appended claims to cover any such modification and other embodiments as incorporated in those features which constitute the essential features of this invention within the true spirit and scope of the following claims.

What is claimed is:

1. An intermediate support member for disposition between two storage units arranged in end-to-end alignment with one another when suspended on a vertical panel partition, means for suspending said support member on such a partition, and means for attaching the respective adjacent ends of such storage units to said intermediate support member and including adjustable take-up tension means for transferring tensile forces between the lower portions of such storage units to form an integral rigid unit of said storage units and said intermediate support member when suspended on such a partition.

2. In combination with a vertical panel partition and storage units for suspension on such a partition, the improvement comprising an intermediate support member designed for disposition between two such storage units arranged in end-to-end alignment with one another and suspended on said partition, and means for attaching the respective adjacent ends of said storage units to said intermediate support member and including adjustable take-up tension means for transferring tensile forces between the lower portions of such storage units to form an integral rigid unit of said storage units and said intermediate support member when suspended on such a partition.

3. The invention of claim 2 including means for suspending said support member on said partition.

4. A storage assembly for suspension on a vertical panel-type partition, said storage assembly comprising first and second storage units to be arranged in end-to-end relation with one another, means for supporting each of said storage units on such a partition, an intermediate support member for disposition between said storage units, and means for attaching the respective adjacent ends of said storage units to said intermediate support member and including adjustable take-up tension means for transferring tensile forces between the lower portions of such storage units to form an integral rigid unit of said storage units and said intermediate support member when suspended on such a partition.

5. The invention of claim 4 including means for suspending said support member on said partition.

6. The invention of claim 4 wherein said attaching means further comprises hook hangers on the respective adjacent ends of said storage units and cooperative recesses in said intermediate support member for receiving said hangers.

7. The invention of claim 1, 2, 3, 4 or 5 including hangers on each end of each of said storage units for engaging such a partition and said intermediate support member.

8. The invention of claim 1, 2, 3, 4 or 5 wherein said attaching means is detachable.

9. A partition system comprising a plurality of partition panels joined to one another to form a vertical partition, first and second storage units arranged in end-to-end relation with one another, cooperative means on said storage units for supporting each of said storage units on said panels, an intermediate support member disposed between said storage units, further cooperative means on said intermediate support member and said panels for supporting said intermediate member on said panels, and means for attaching the respective adjacent ends of said storage units to said intermediate support member and including adjustable take-up tension means for transferring tensile forces between the lower portions of such storage units to form an integral rigid unit of said storage units and said intermediate support member when suspended on such a partition.

10. The invention of claim 1, 2, 3, 4, 5 or 9 in which said means for supporting or suspending said storage units and said intermediate support member on such panels comprise hook shape hangers on the upper portions of said storage units and said intermediate support member, and cooperative recesses in said panels, for receiving said hangers.

11. The invention of claim 10 and including hook shape hangers on the respective adjacent ends of said storage units and cooperative recesses in said intermediate support member for receiving said clips.

12. The invention of claim 2, 3, 4, 5 or 9 in which said partition panels are of modular width and said storage units are of modular length to fit between panels extending laterally at opposite ends of one such partition panel, said partition comprising a span of at least two such partition panels in generally coplanar alignment with one another, and laterally extending panels at each end of said span which are spaced from one another a distance slightly exceeding an even multiple of such modular length, said intermediate support member being of a thickness whereby said rigid unit is of a length corresponding to said distance whereby said rigid unit extends between said last-mentioned laterally-extending panels and is suspended thereon.

13. The invention of claim 12 wherein such an intermediate support member is disposed in alignment with each joint between such partition panels and is supported on the respective partition panel at each side of the respective joint.

14. The invention of claim 2, 3, 4, 5 or 9 in which said partition panels are of a first modular width and said storage units are of a second modular length which is less than said first modular width and corresponds to the spacing between panels extending laterally at opposite ends of one such partition panel, said partition providing multiple-panel spans of a length between lateral panels slightly exceeding multiples of such modular length, and said intermediate support member being of a thickness whereby said rigid unit is of a length of such span between such lateral panels.

15. The invention of claim 1, 3, 5 or 9 including tab means on said support member for engaging a shoulder on such panels to prevent disengagement of said support member from such panels.

16. The invention of claim 3, 5 or 9 wherein said storage units include cooperative interengaging means for preventing disengagement of said storage units from said partition and from said intermediate support member.

17. The invention as in claim 16 wherein said interengaging means comprises a tab projecting from each of said storage units and a shoulder on said intermediate support member and each panel, said storage units maintaining engagement of said tabs and shoulders.

* * * * *